US008413586B2

(12) United States Patent
Van Stratum

(10) Patent No.: US 8,413,586 B2
(45) Date of Patent: Apr. 9, 2013

(54) DOOR BREACHING PROJECTILE SYSTEM

(75) Inventor: Bruce G. Van Stratum, Tallahassee, FL (US)

(73) Assignee: Chemring Ordnance, Inc., Perry, FL (US)

( * ) Notice: Subject to any disclaimer, the term of this patent is extended or adjusted under 35 U.S.C. 154(b) by 83 days.

(21) Appl. No.: 12/657,405

(22) Filed: Jan. 19, 2010

(65) Prior Publication Data

US 2011/0174187 A1 Jul. 21, 2011

(51) Int. Cl.
*F42B 30/04* (2006.01)

(52) U.S. Cl.
USPC ..... 102/477; 102/488

(58) Field of Classification Search ..... 102/231, 102/266, 262, 270–272, 477, 216, 275, 488, 102/482
See application file for complete search history.

(56) References Cited

U.S. PATENT DOCUMENTS

| | | | | | |
|---|---|---|---|---|---|
| 133,714 | A | * | 12/1872 | Mead, Jr. | 102/430 |
| 769,884 | A | * | 9/1904 | Baumgart | 102/500 |
| 1,325,758 | A | * | 12/1919 | Semple | 102/231 |
| 1,547,598 | A | * | 7/1925 | Lukens et al. | 102/235 |
| 1,547,599 | A | * | 7/1925 | Lukens | 102/235 |
| 1,723,315 | A | * | 8/1929 | Teitscheid | 102/271 |
| 3,486,452 | A | * | 12/1969 | Glowacki | 102/210 |

* cited by examiner

*Primary Examiner* — Michael Carone
*Assistant Examiner* — Reginald Tillman, Jr.
(74) *Attorney, Agent, or Firm* — J. Wiley Horton

(57) ABSTRACT

A modified 40 mm grenade round designed to breach doors without throwing a substantial amount of shrapnel into a building's interior. The modified round includes a standoff device located on its forward end. The standoff device detonates the explosive charge within the projectile before the nose of the projectile actually strikes the target. This early detonation throws a pressure wave again the door's exterior, forcing the door inward. Shrapnel produced by the detonation remains primarily outside the door. Thus, the modified projectile is able to blow open a door without throwing a significant amount of shrapnel into a building's interior.

18 Claims, 17 Drawing Sheets

DOOR BREACHING PROJECTILE SYSTEM

BACKGROUND OF THE INVENTION

1. Field of the Invention

This invention relates to the field of projectile delivery systems. More specifically, the invention comprises a stand-off device configured to detonate the explosives in a projectile before the nose of the projectile strikes a target.

2. Description of the Related Art

Although the present invention can be applied to many different types of projectiles, it was primarily developed as a component of existing 40 mm grenade weapons (such as the U.S. Army's M-433). FIG. 1 depicts prior art 40 mm grenade round 10. Its two main components are case 12 (which houses the propulsion system) and projectile 14. The grenade round is designed to be fired from a variety of weapons. One example is the U.S. Army's M-203 grenade launcher which is typically slung beneath the barrel of a rifle such as the M-16A2.

The launching of a 40 mm grenade involves the same principles as a conventional rifle cartridge. The main difference, however, is the size and mass of the projectile. A typical shoulder-fired military weapon launches a projectile weighing less than 30 grams at a relatively high velocity (700-1,000 meters per second). In contrast, a 40 mm grenade weapon launches a projectile weighing over 200 grams at a relatively low velocity (70-80 meters per second). Thus, while the operating principles between the two types of weapons are the same, they can be said to operate in different regimes.

The unified 40 mm grenade round 10 is placed in the launching weapon and then fired. Case 12 remains within the weapon. Projectile 14 is propelled down the weapon's bore. Rifling ring 26 engages internal rifling on the firing weapon's bore and spins the projectile in order to stabilize it in flight.

The leading end of the projectile assumes the form of ogive 28. Those skilled in the art will know that the term "ogive" sometime refers to a specific pointed shape used for missile nose cones. However, the term is also more broadly used to mean the nose portion of any flying projectile. In this disclosure, "ogive" is given the latter meaning. The ogive generally contains the arming and detonating mechanisms. The volume between the ogive and the rifling ring typically contains the explosive.

FIG. 2 shows the same 40 mm grenade round of FIG. 1 cut in half to reveal its internal details. Projectile 14 includes a hollow volume defined by the combination of ogive 28, casing 36, and aft closure 38. These three components are joined together by suitable means, such as threaded engagements.

Explosive 34 is contained within casing 36. Fuse assembly 30 is contained within ogive. It activates spitback detonator 32, which ignites the explosive. The casing is preferably scored to form a series of rectangles which will break into relatively small pieces when the explosive detonates.

The propulsion system contained within case 12 is often referred to as a "high-low" system. While a detailed discussion of this system is beyond the scope of this disclosure, a brief description may aid the reader's understanding of the environment in which the present invention operates. The "high" part of the system refers to high pressure chamber 18. This chamber is often created by the insertion of a metallic case filled with propellant into base 16. The open end of the metallic case is closed by burst diaphragm 22. A primer is contained in the opposite end.

A mechanical striker is used to detonate this primer which then causes the propellant within the high pressure chamber to ignite. This action ruptures the burst diaphragm. The expanding propellant gases are then metered through nozzle 24 into low pressure chamber 20. These relatively low pressure gases act against the aft end of aft closure 38, thereby propelling the projectile down the firing weapon's bore. For a more detailed discussion of the propulsion system of the M-433, the reader may wish to review U.S. Pat. No. 7,004,074 to Van Stratum (2006), which is hereby expressly incorporated by reference.

A detailed description of the fuse assembly is likewise beyond the scope of this disclosure. However, a fuse assembly typically contains a number of safety features designed to prevent accidental detonation. For example, in some embodiments, the fuse can only be armed when the projectile first experiences a violent forward acceleration followed by a rotation at a minimum rotational velocity. The presence of these two cues indicates that the projectile has been intentionally and successfully fired from a weapon. The fuse assembly will then arm itself during flight. Once armed, any sudden deceleration (such as the projectile impacting a surface) will ignite spitback detonator 32 and explode the grenade.

A typical fuse assembly is the M-550 fuse used by the U.S. Army. A discussion of the details of the fuse assembly is beyond the scope of this disclosure. However, the reader wishing to know these details is referred to U.S. Pat. No. 5,081,929 to Mertens (1992).

The assembly shown in FIGS. 1 and 2 functions very well. FIG. 3 shows projectile 14 flying toward a target. FIG. 4 shows the projectile striking a target and detonating. Target surface 42 is in this example a reinforced piece of concrete (a hard target). The explosion throws shrapnel 40 in all directions away from the point of impact. FIG. 5 shows the result, with void 44 being blown into target surface 42. The projectile is primarily intended as an anti-personnel weapon, and the wide dispersal of shrapnel is obviously effective in this regard.

FIG. 6 shows an idealized depiction of the detonation of explosive 34. Explosive pressure is generally emitted in a direction normal to the surface of the volume of explosive. As the explosive volume depicted is cylindrical, it will emit lateral pressure wave 50 (roughly in the shape of an expanding cylinder), forward pressure wave 46, and rearward pressure wave 48. The shape of these pressure waves determine in large part how shrapnel created by the explosion will fly.

It has long been known to use a 40 mm grenade as a door breaching round. However, it is often not optimal in this role. In anti-insurgency operations, soldiers must often penetrate occupied buildings. In many instances, it is not known whether the occupants are hostile. However—hostile or not—the occupants will not voluntarily open the door. Thus, the door mush be breached.

FIGS. 7 and 8 shows the use of a prior art 40 mm grenade round in this role. In FIG. 7, projectile 14 impacts door 52 at a significant velocity (typically about 70 meters per second). Ogive 28 knocks breach 54 into the face of the door. The sudden deceleration ignites the fuse assembly, so spitback detonator 32 ignites the explosive. FIG. 8 shows the result. The expanding pressure waves from the exploding projectile destroy the door and explosion 58 sends flying debris 56 into the occupied structure. Persons within the structure may be injured or killed.

Thus, while the prior art 40 mm grenade round is effective in breaching doors, it may produce unwanted collateral damage. A system which can breach the door without throwing shrapnel into an occupied structure would be preferable.

BRIEF SUMMARY OF THE INVENTION

The present invention is a modified 40 mm grenade round designed to breach doors without throwing a substantial amount of shrapnel into a building's interior. The modified round includes a standoff device located on its forward end. The standoff device detonates the explosive charge within the projectile before the nose of the projectile actually strikes the target. This early detonation throws a pressure wave again the door's exterior, forcing the door inward. Shrapnel produced by the detonation remains primarily outside the door. Thus, the modified projectile is able to blow open a door without throwing a significant amount of shrapnel into a building's interior.

REFERENCE NUMERALS IN THE DRAWINGS

| | | | |
|---|---|---|---|
| 10 | 40 mm grenade round | 12 | case |
| 14 | projectile | 16 | base |
| 18 | high pressure chamber | 20 | low pressure chamber |
| 22 | burst diaphragm | 24 | nozzle |
| 26 | rifling ring | 28 | ogive |
| 30 | fuse assembly | 32 | spitback detonator |
| 34 | explosive | 36 | casing |
| 38 | aft closure | 40 | shrapnel |
| 42 | target surface | 44 | void |
| 46 | forward pressure wave | 48 | rearward pressure wave |
| 50 | lateral pressure wave | 52 | door |
| 54 | breach | 56 | flying debris |
| 58 | explosion | 60 | standoff device |
| 62 | base | 64 | tube |

-continued

| | | | |
|---|---|---|---|
| 66 | contactor | 67 | flange |
| 68 | door frame | 70 | steel door |
| 72 | steel bar door | 74 | tip |
| 76 | contactor | 78 | cannelure |
| 80 | cannelure crimp | | |

DETAILED DESCRIPTION OF THE INVENTION

Figure 1:
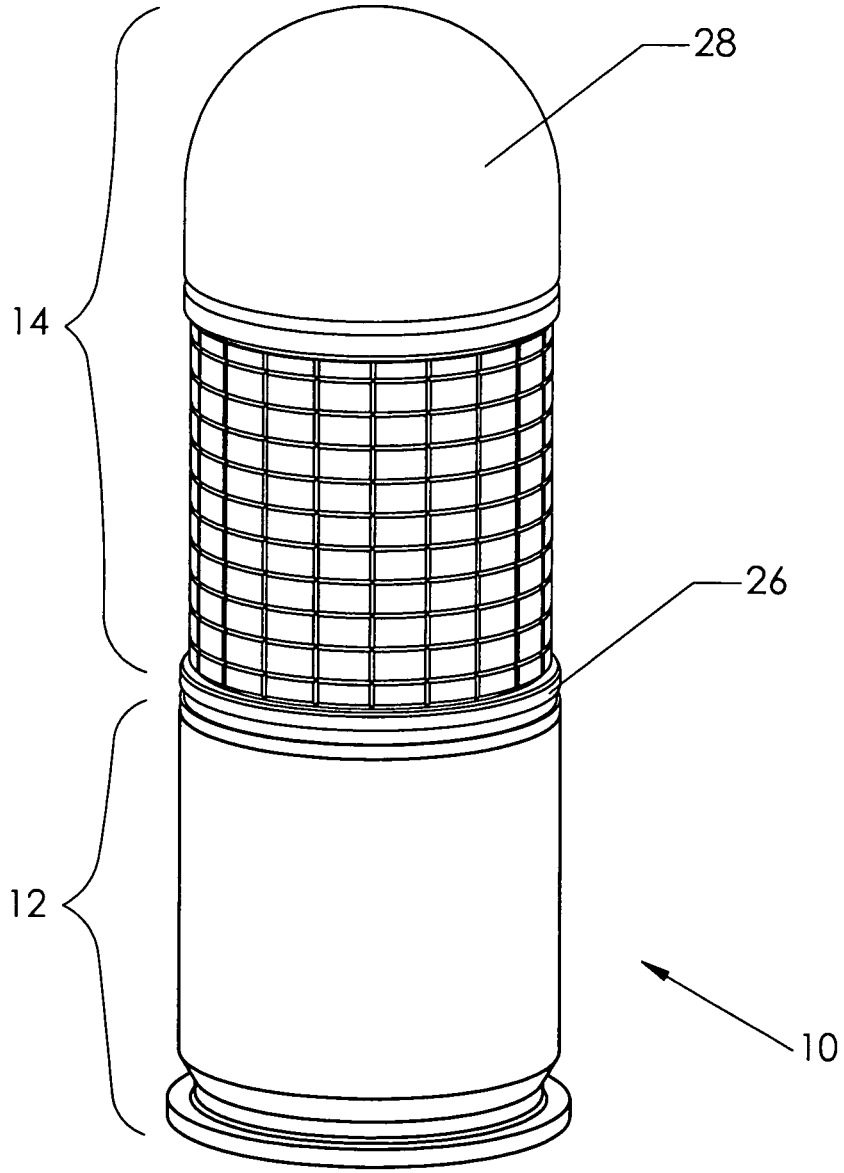
FIG. 1 (PRIOR ART)
FIG. 1 is a perspective view, showing a prior art 40 mm grenade round.
Figure 2:
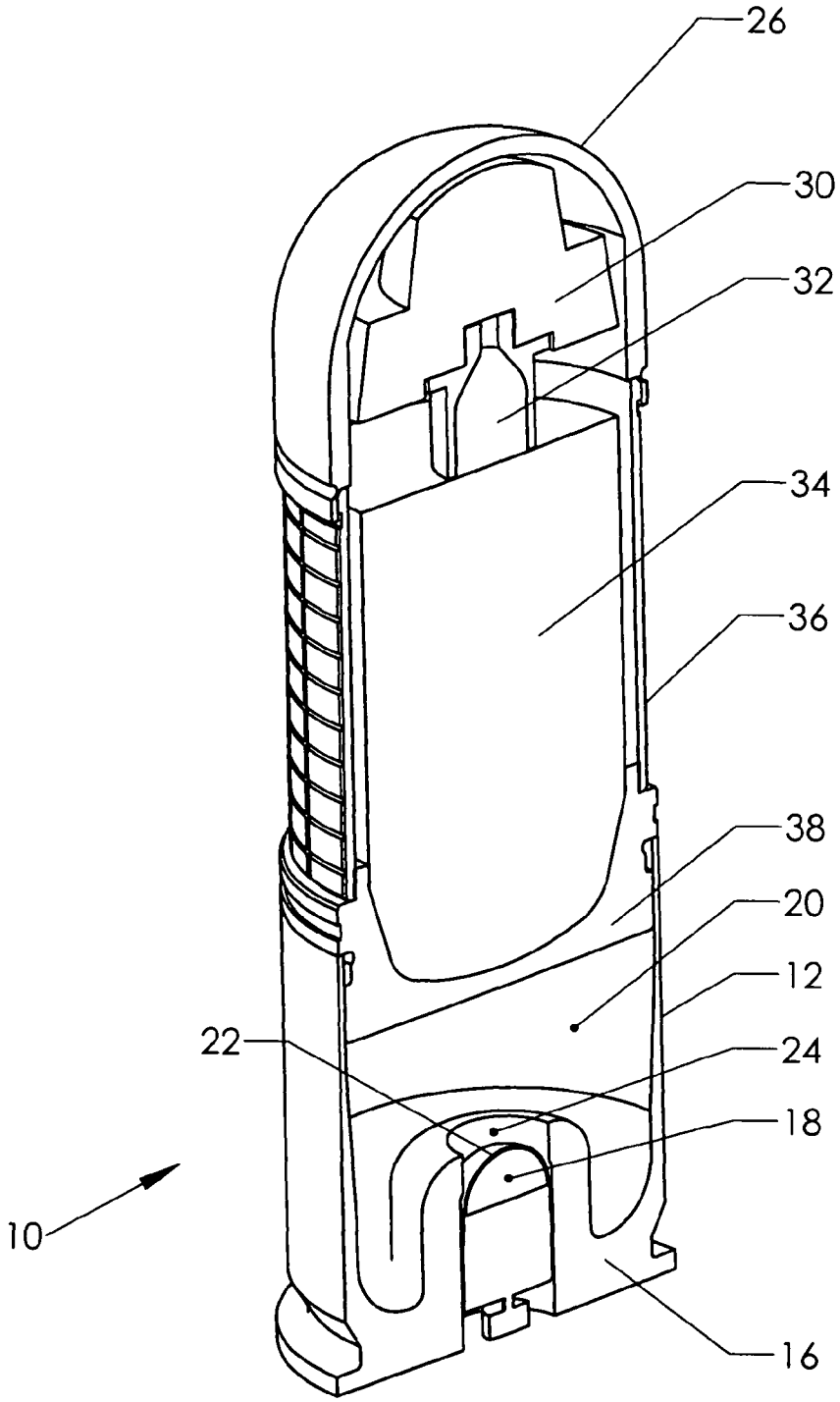
FIG. 2 (PRIOR ART)
FIG. 2 is a perspective view with a cutaway, showing internal details of the prior art grenade round.
Figure 3:
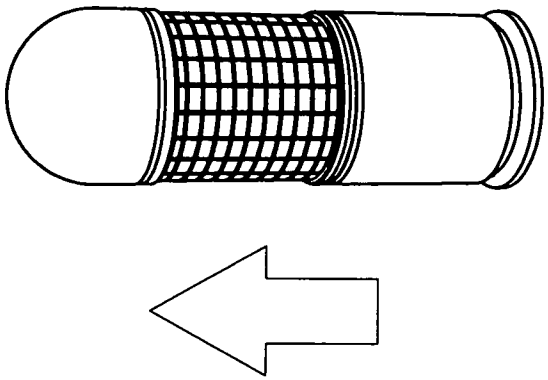
FIG. 3 (PRIOR ART)
FIG. 3 is a perspective view, showing a prior art projectile in flight.
Figure 4:
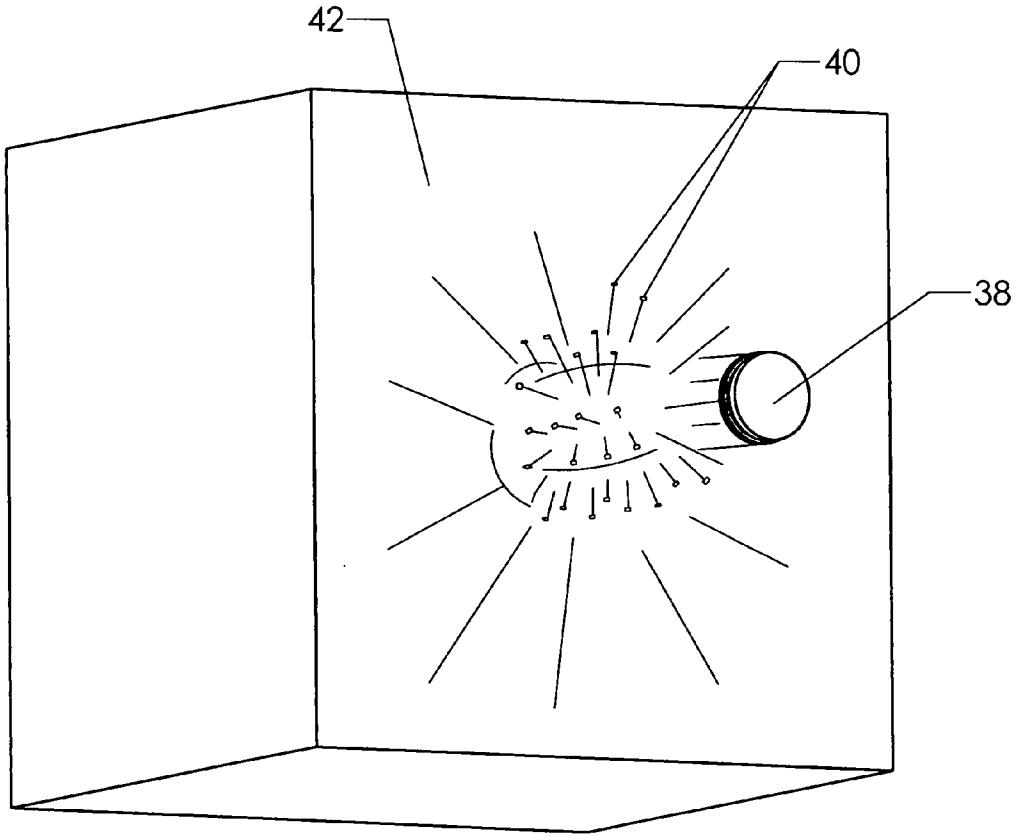
FIG. 4 (PRIOR ART)
FIG. 4 is a perspective view, showing the detonation of the projectile upon striking the target.
Figure 5:
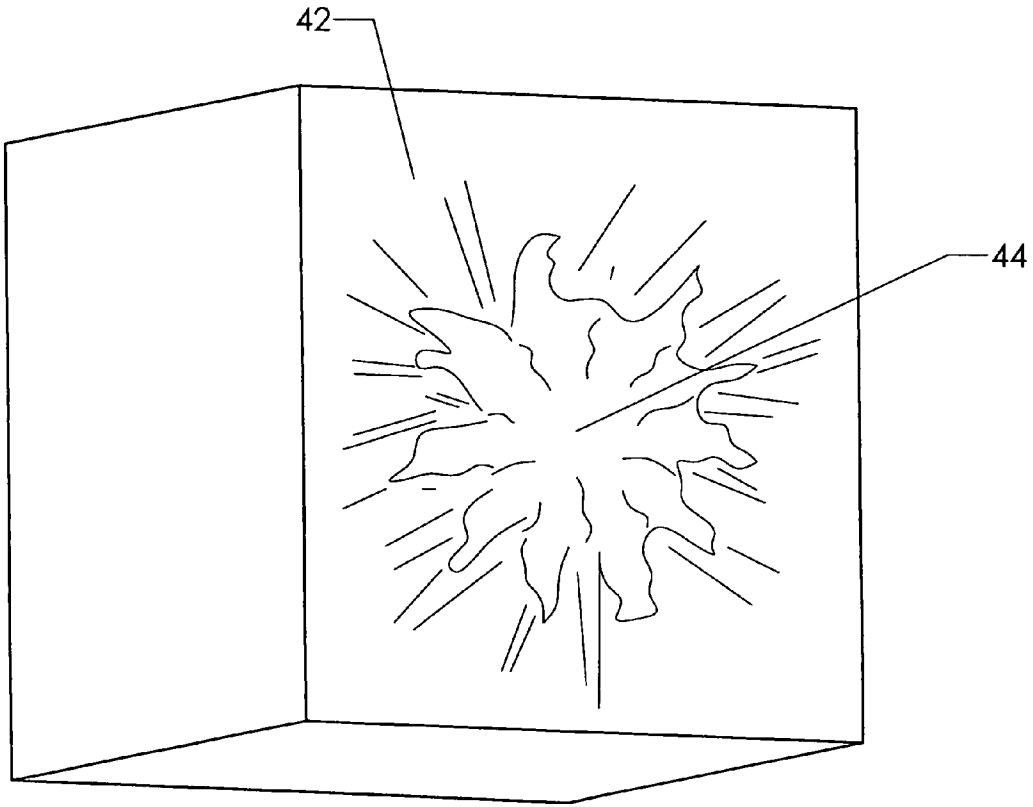
FIG. 5 (PRIOR ART)
FIG. 5 is a perspective view, showing the resulting damage to the target.
Figure 6:
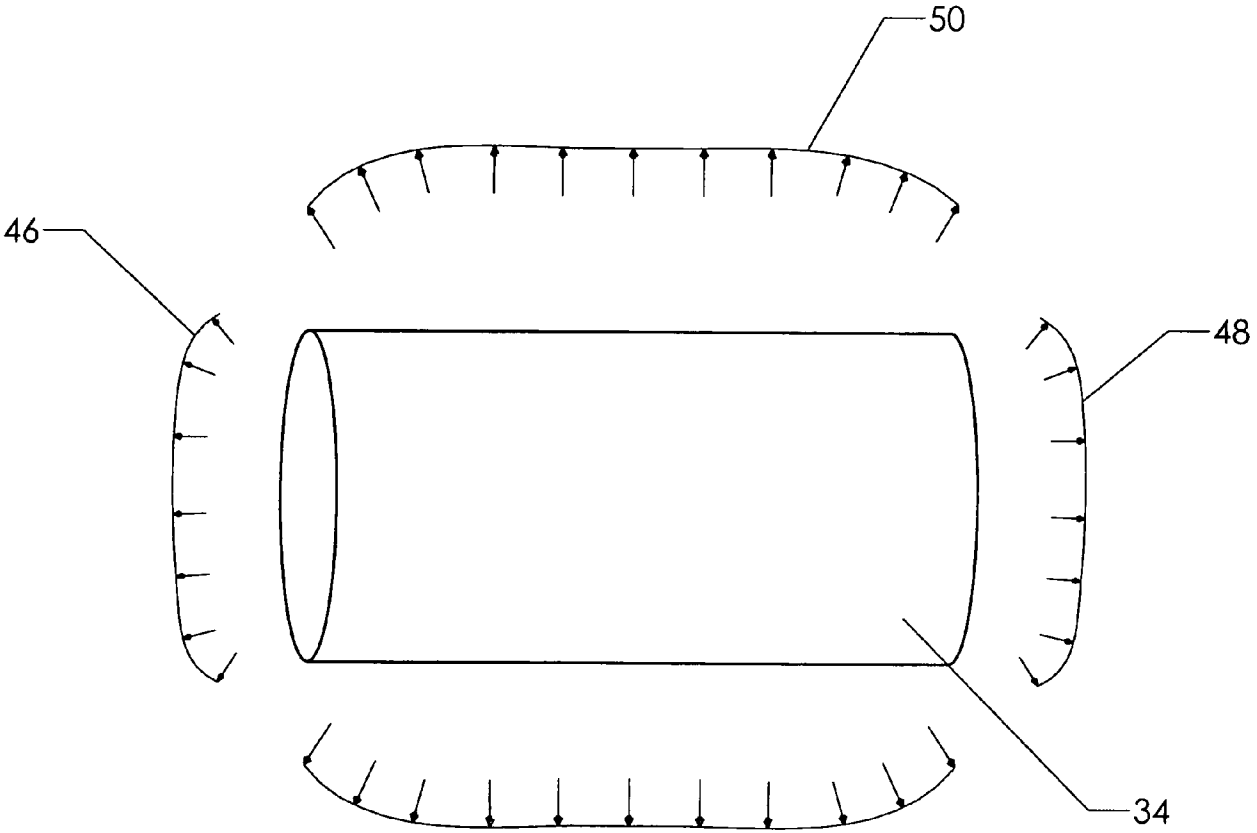
FIG. 6 (PRIOR ART)
FIG. 6 is a perspective view, showing the expanding pressure waves caused by the detonation of a cylindrical volume of explosive material.
Figure 7:
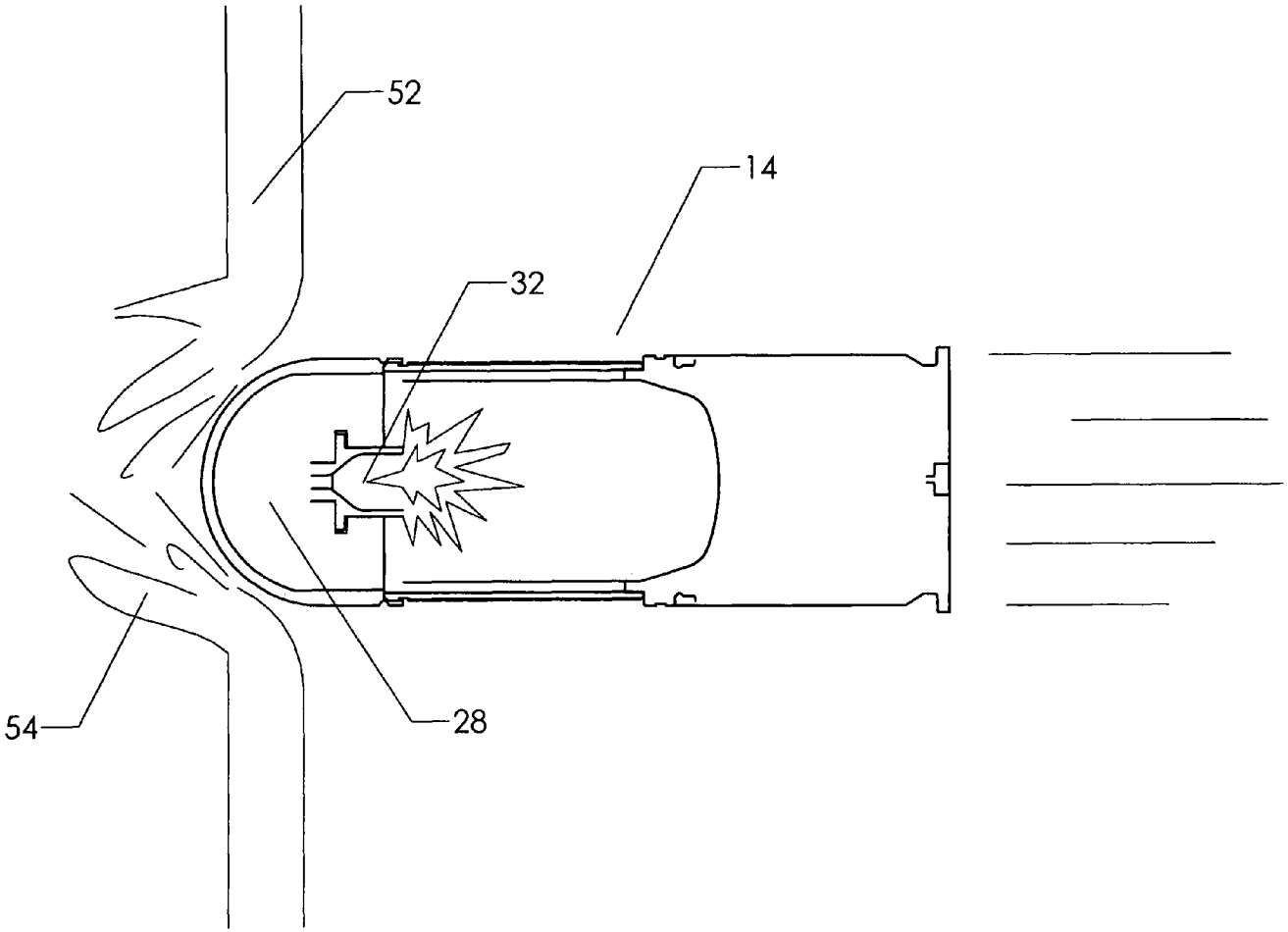
FIG. 7 (PRIOR ART)
FIG. 7 is an elevation view, showing a prior art projectile striking a door.
Figure 8:
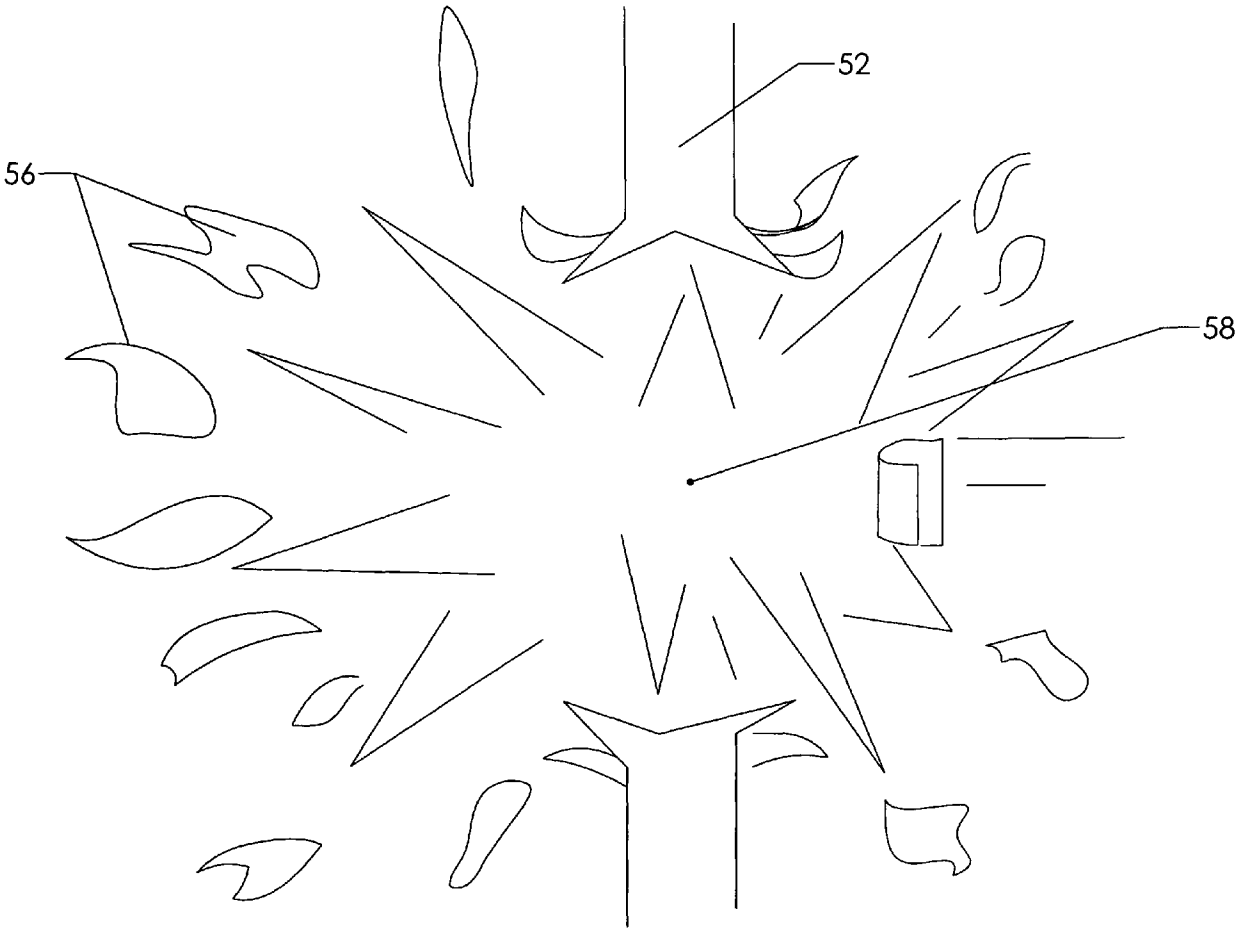
FIG. 8 (PRIOR ART)
FIG. 8 is an elevation view, showing a prior art projectile destroying a door.
Figure 9:
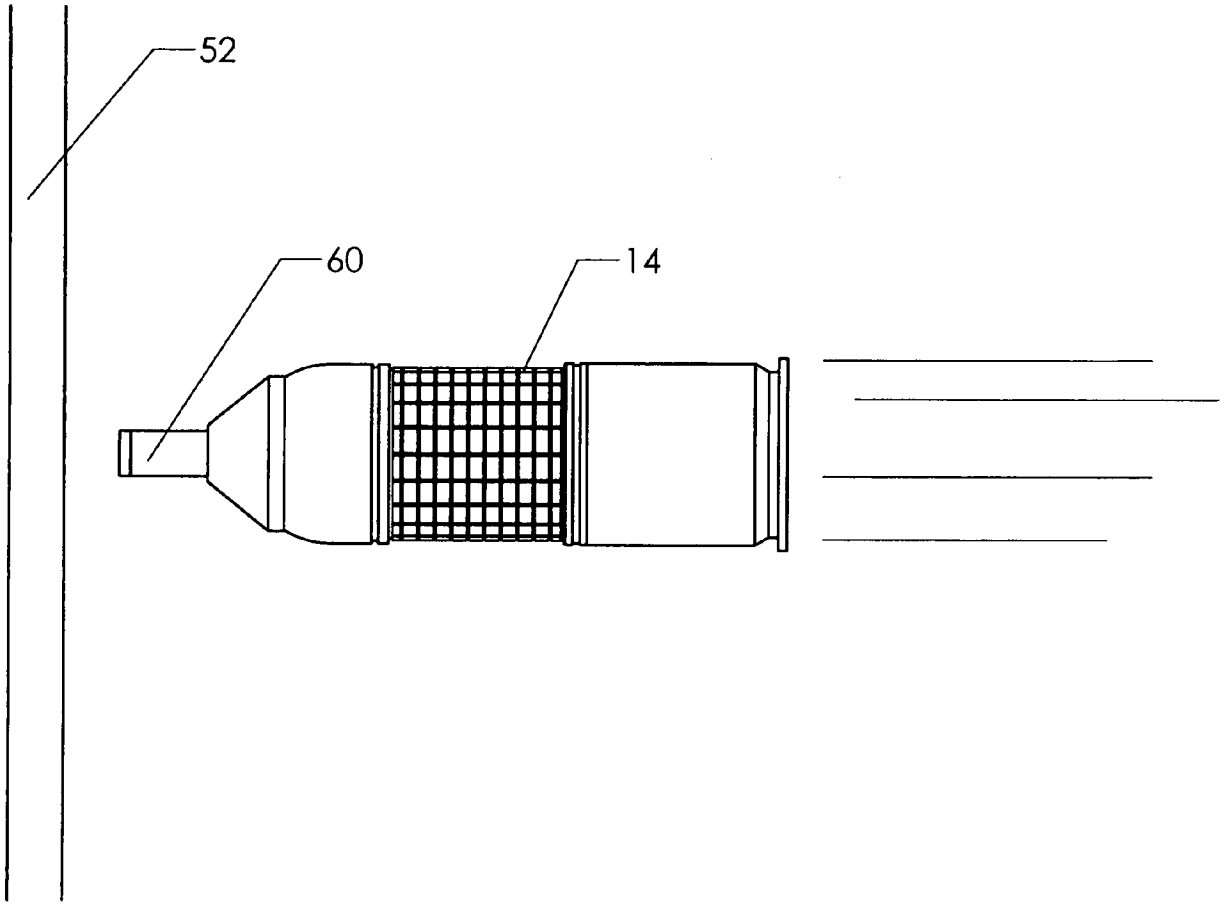
FIG. 9 is an elevation view, showing a projectile made according toe h present invention approaching a door.

FIG. 9 shows an elevation view of a projectile 14 made according to the present invention (shown in flight toward a target). The projectile has a central axis of symmetry, about which it spins during flight. The reader will observe that standoff device 60 has been added to the projectile's forward portion along this central axis. The standoff device contacts door 52 and transmits a sharp deceleration to the projectile, causing it to explode. When compared to the prior art projectile's detonation upon contact between the ogive and the door, the detonation in the present case can be said to be "early." The early detonation is advantageous in certain circumstances—as will be seen.

Figure 10:
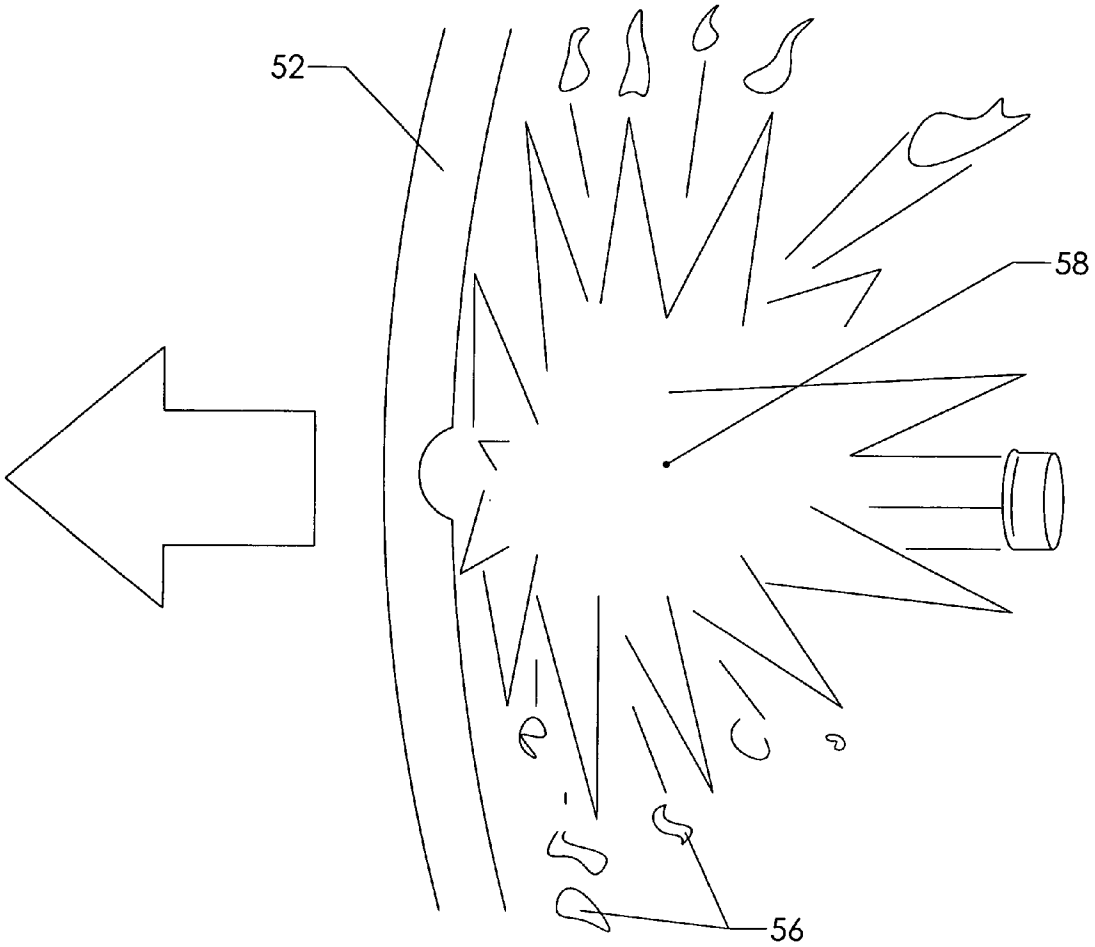
FIG. 10 is an elevation view, showing the detonation of the projectile of FIG. 9.

FIG. 10 shows the detonation of the projectile by operation of standoff device 60. Explosion 58 has occurred while the majority of the projectile remains outside the door. The resulting blast pressure wave propels the door inward. Flying debris 56 remains primarily outside the door. Thus, the projectile has created a door-breaching pressure wave without introducing flying debris inside the structure. Further, a significantly improved result has been achieved using only a relatively small modification.

Figure 11:
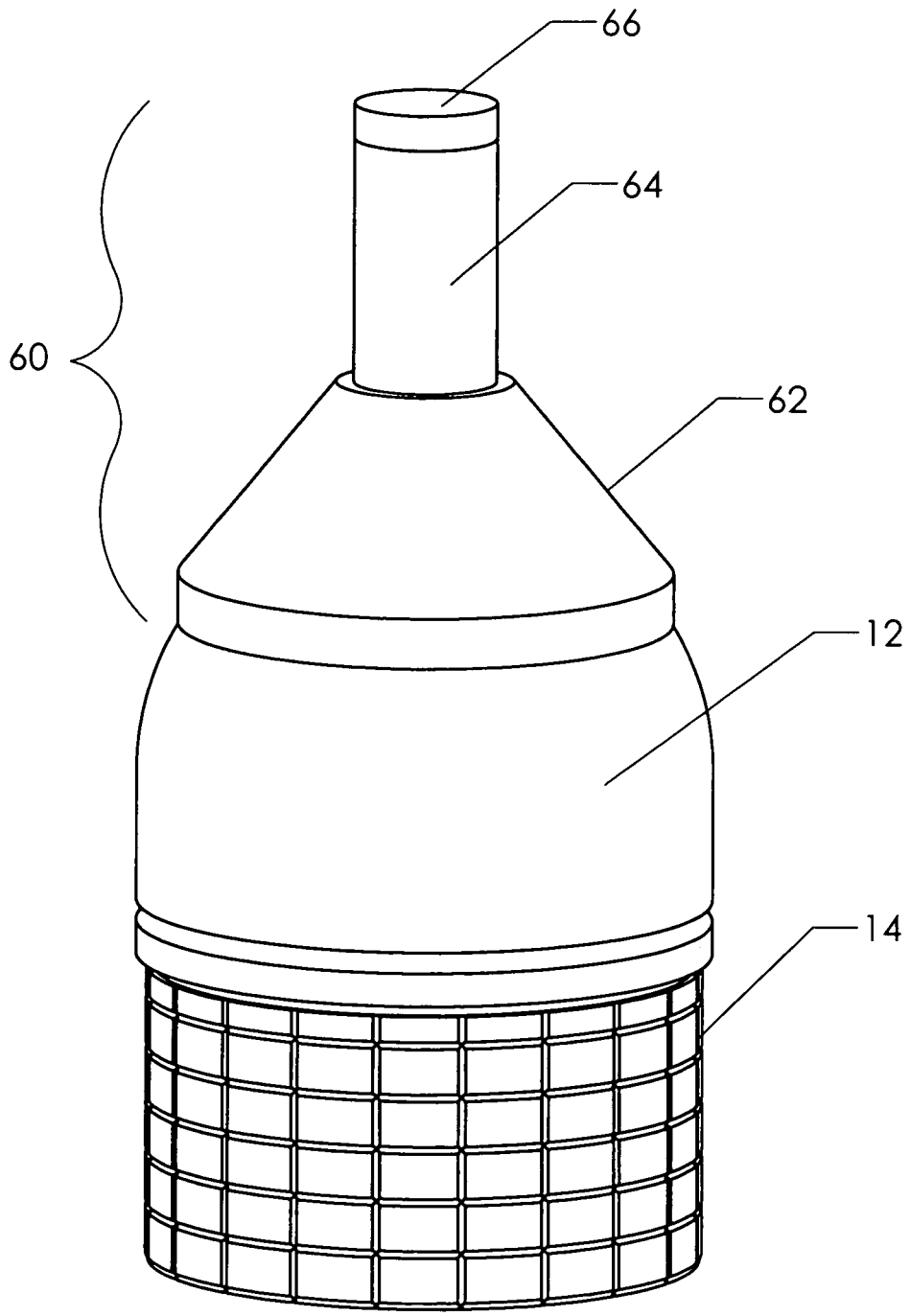
FIG. 11 is a perspective view, showing the addition of a standoff device to the front of a projectile.

The actual structure of the standoff device can assume many forms, and any particular example should not be viewed as limiting. However, the provision of a few examples will aid the reader's understanding. FIG. 11 provides one such example. As for the prior art, ogive 12 encloses the projectile's forward end. Base 62 is connected to ogive 12 by any suitable means. The connection can be made by adhesive, mechanical fasteners, threads, brazing material, or other known means. Base 62 houses tube 64 and contactor 66 (which collectively comprise standoff device 60).

Figure 12:
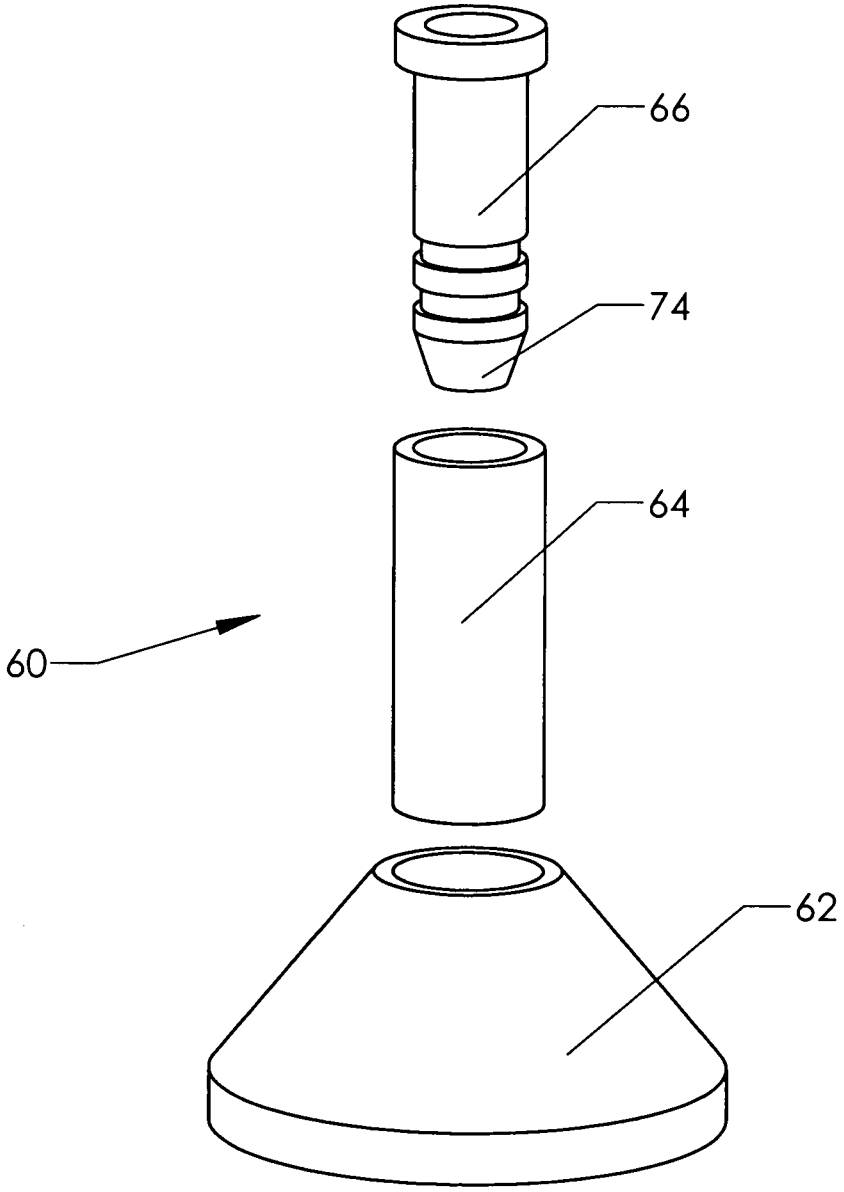
FIG. 12 is an exploded perspective view, showing details of the standoff device.

FIG. 12 shows an exploded view of these components. Tube 64 fits within a hole in base 62. Contactor 66 fits within the tube's hollow interior. Tip 74 is positioned to strike ogive 12 when contactor 66 strikes a target surface.

The fit of the contactor within the standoff device is preferably configured to minimize the risk of unwanted movement (and consequent premature detonation). The reader will observe that the contactor includes a flange near its forward extreme that laps over the end of the tube. The contactor preferably also includes circumferential or other serrations intended to create sliding resistance between itself and the tube.

Figure 13:
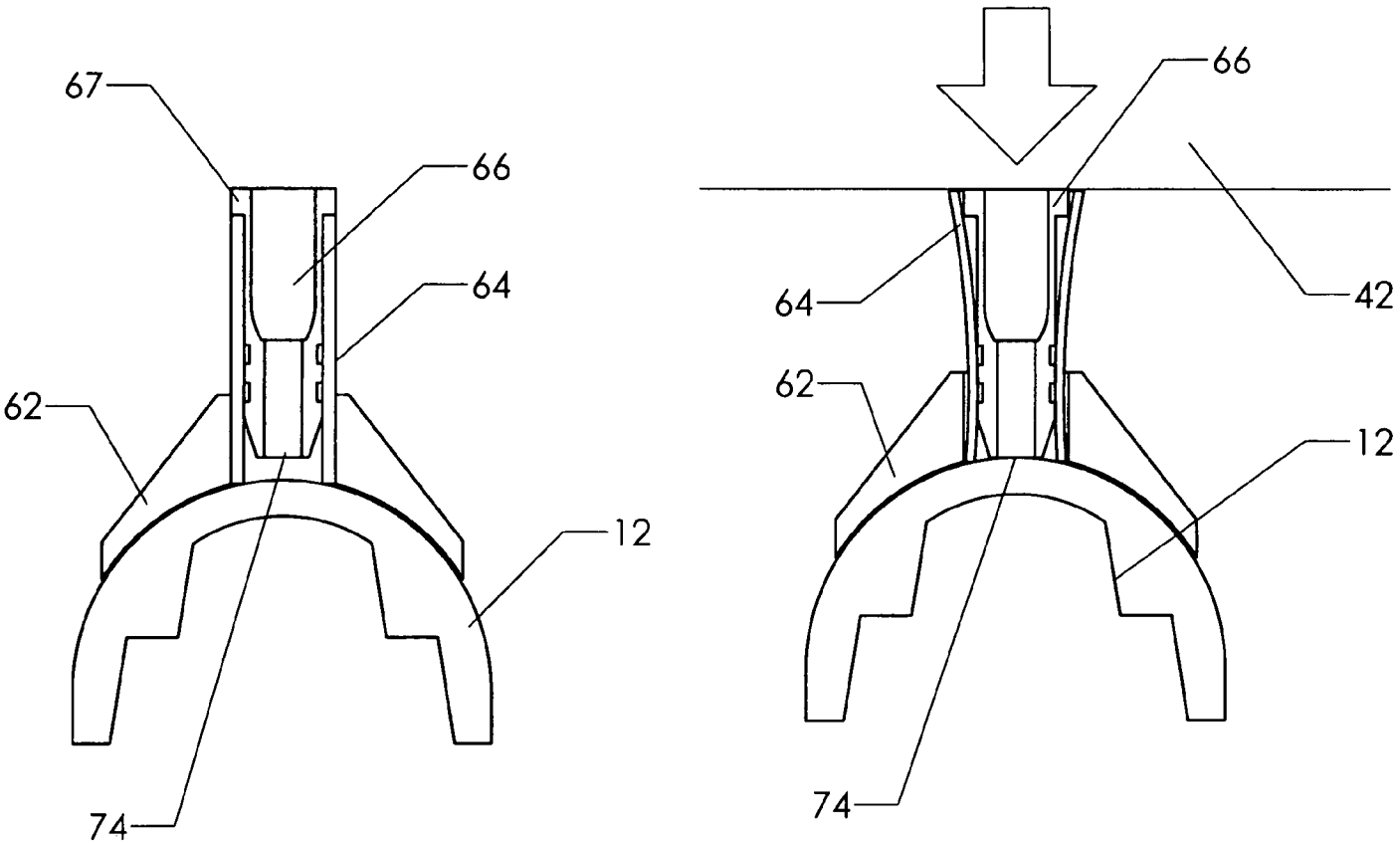
FIG. 13 is a sectioned elevation view, showing the operation of the standoff device.

FIG. 13 shows a sectioned elevation view depicting the operation of the standoff device. In the left view the contactor is in position on ogive 12. The reader will observe that base 62 has a cavity designed to receive the shape of ogive 12 (The cavity opens downward in the orientation shown in the view to receive the upward facing ogive). Tube 64 fits securely within a corresponding passage provided in the base. The tube can be attached via a press fit, a sliding fit secured with adhesive, a threaded engagement, or some other suitable fastener. Contactor 66 is pressed into the open end of tube 64 until the contactor's flange 67 comes to rest against the tube's forward extreme as shown. The reader will observe that tip 74 is separated from ogive 12. This separation, which is optional, can be used to provide a slight delay in the detonation sequence.

In the right hand view of FIG. 13, contactor 66 has contacted a target surface and has consequently been propelled toward ogive 12. The contactor's flange has been driven into the tube and plastically deformed the tube along its progress. Tip 74 has contacted ogive 12 and imparted a substantial deceleration to the projectile. Those skilled in the art will know that such a substantial deceleration will cause the fuse mechanism to detonate the explosive contained within the warhead.

It is instructive to consider the timing effect of the standoff device. At the time of impact, a 40 mm grenade is typically traveling at about 70 meters per second. The standoff device effectively "projects" the nose of the projectile forward a set distance (which is typically less than the overall length of the standoff device owing to the separation of the tip from the ogive, the crush timing of the tube, etc.), thereby creating an "early" detonation. If the effective distance is 3 cm, then a projectile traveling at 70 m/s (7,000 cm/s) will detonate approximately 3/7,000 or $4.3\times10^{-4}$ seconds earlier than a prior art projectile.

There is of course a delay in the operation of the fuse mechanism and the spitback detonator but—as those skilled in the art will know—the operation of these devices is typically measured in microseconds. The result of the standoff device is the projectile detonating just outside the door instead of detonating as the ogive is actually penetrating the door.

Figure 14:
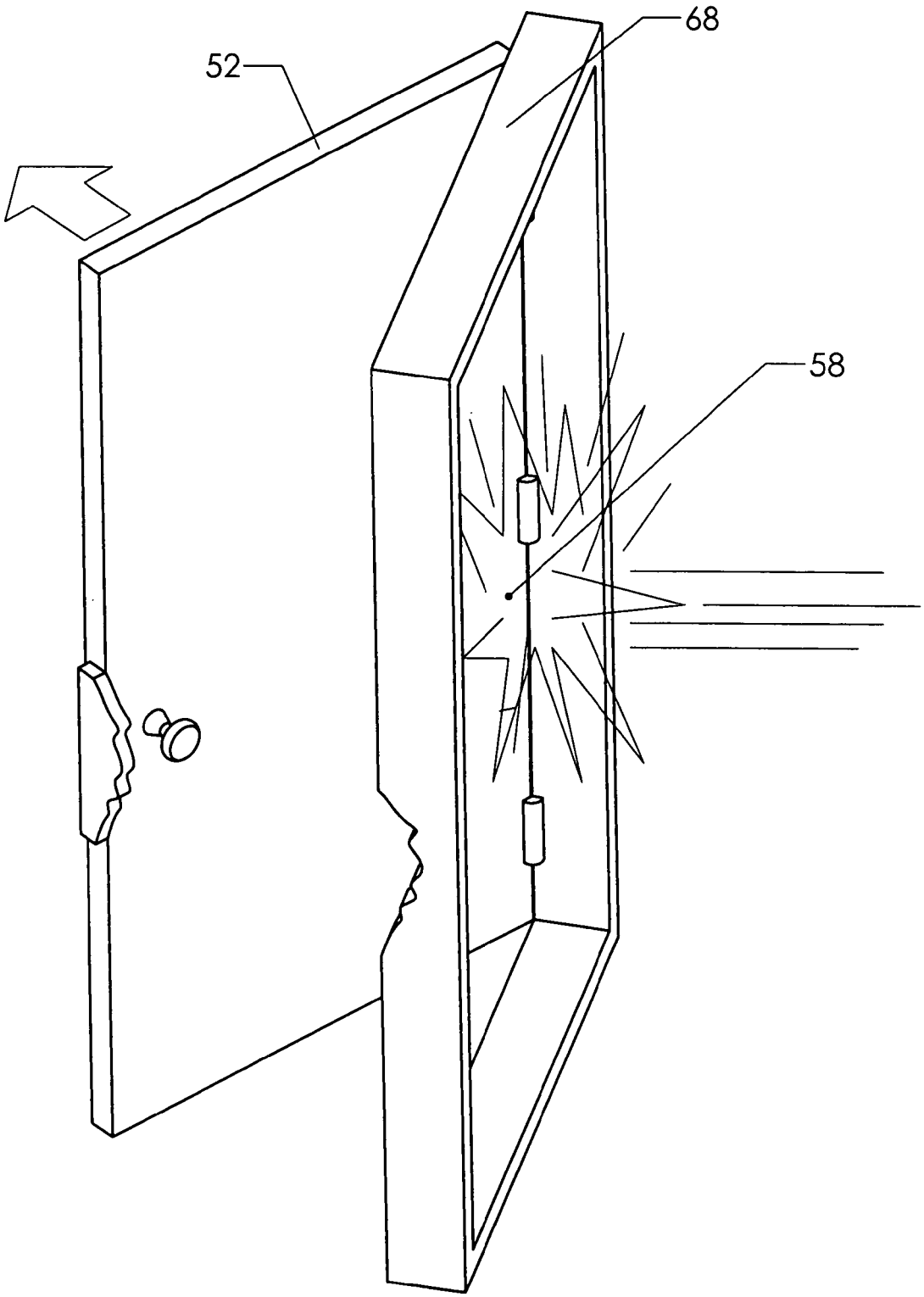
FIG. 14 is a perspective view, showing a door being blown open by the present invention.
Figure 15:
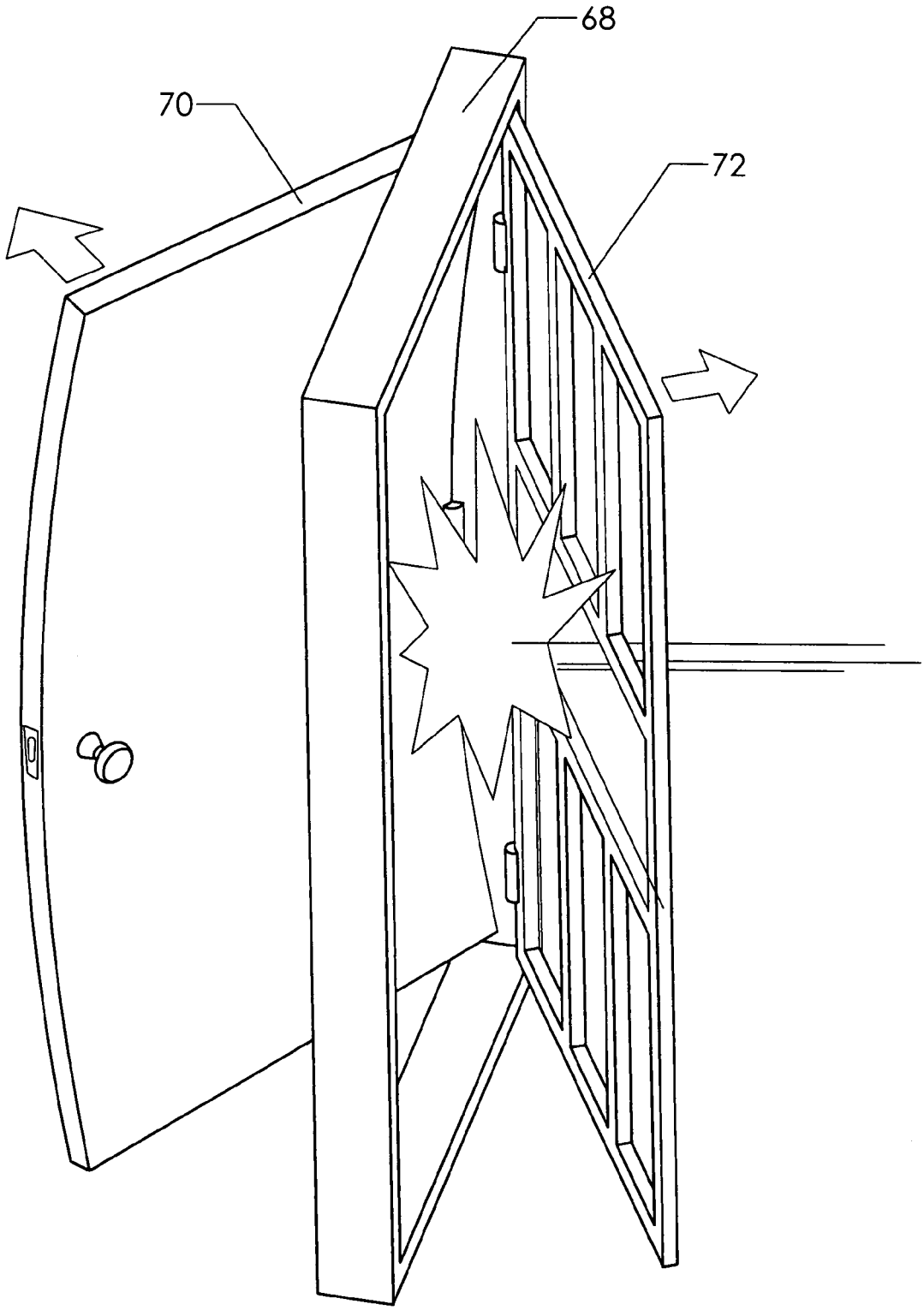
FIG. 15 is a perspective view, showing a steel door being blown open by the present invention.

FIGS. 14 and 15 show the present invention in operation. In FIG. 14, a projectile including a standoff device has been fired at a wooden door 52 within door frame 68. Explosion 58 has sent a pressure wave against the outward-facing surface of the door, blasting the door inward. Wooden doors and frames typically fail by tearing the striker plate out of the frame or the bolt mechanism out of the door. Neither of these modes is likely to throw flying debris into the structure. The external detonation has breached the door while keeping most—if not all—of the shrapnel outside the structure.

FIG. 15 shows the device being used against a steel door 70 in a steel door frame. The projectile has again detonated outside the door. The substantial pressure wave will often warp a steel door and thereby pull its bolt free of the striker assembly.

FIG. 15 shows another operational feature. In some installations a steel door is hinged to open inward while a steel bar door 72 (a "burglar bar door") is hinged to open outward. The properly constructed standoff device causes the projectile to detonate while it is between the doors. The resulting pressure waves blow the interior door inward and the steel bar door outward—thereby simultaneously opening both obstacles.

Figure 16:
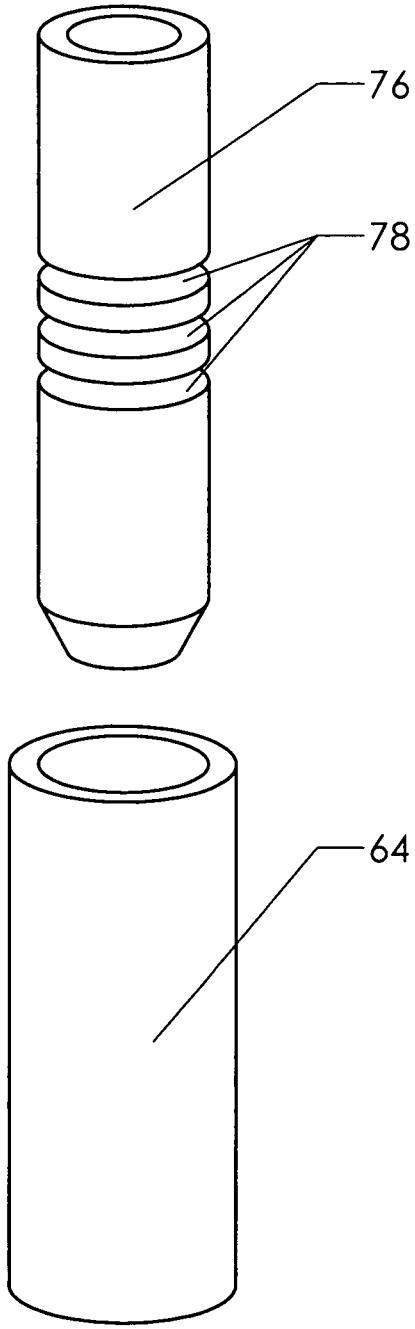
FIG. 16 is an exploded perspective view, showing an alternate embodiment of the standoff device.

As discussed previously, a variety of different designs could be used for the contactor. FIG. 16 shows one such alternate embodiment. In this version contactor 76 includes a series of circumferential cannelures 78 (A "cannelure" is a circumferential groove traditionally used to receive a roll crimped deformation of the mouth of a cartridge case, thereby positively locating a projectile within the mouth of a cartridge case). Tube 64 is a simple hollow cylinder, preferably made of a malleable material such as brass or aluminum.

Figure 17:
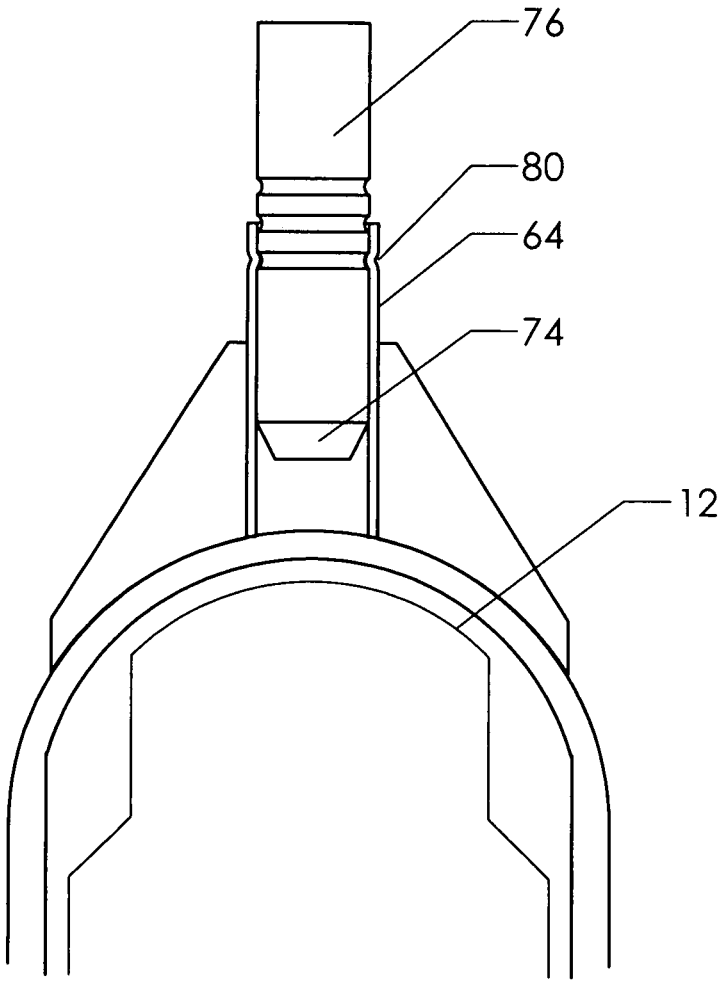
FIG. 17 is a sectioned elevation view, showing the operation of the alternate embodiment of FIG. 16.

FIG. 17 shows a sectioned elevation view of this alternate embodiment installed on a projectile. The base is attached to the ogive as in the prior embodiment. The tube is then held within the base. However, contactor 76 is retained within tube 64 by crimping at least a portion of the tube into one of the cannelures in the contactor. This crimp forms cannelure crimp 80—a circumferential interference between the contactor and the tube.

By studying FIG. 17 the reader will quickly appreciate that this design allows for variation in the offset distance between tip 74 and ogive 12. By selecting which cannelure groove the tube is crimped into, one may easily select this offset distance. The variation of the offset distance varies the timing of the detonation. This, in turn, allows a user to select a greater or lesser standoff distance for the detonation. This would not typically be done in the field, but a variety of standoffs could be provided with various color or other coding to inform the soldier of the standoff distance set for a particular device. A different standoff distance or configuration could be optimized for different door types. One type might be suitable for steel doors while another might be suitable for wooden doors.

The illustrated examples of the standoff device have shown a separate assembly attached to an existing ogive. This need not always be the case. A modified ogive could be fashioned which would incorporate the base as an integral piece. The tube and contactor could also be integrated as a unified piece with each other and possibly the ogive.

However, it is preferable to provide some type of telescoping assembly in the standoff device. This allows the standoff device to detonate the projectile without significantly penetrating the target surface. A completely rigid standoff device—as an example—may penetrate too far into a thin wooden door before detonating.

Finally, the ogive may be modified to allow the selective addition of a standoff device in the field. As an example, the ogive could have a hole in its forward portion designed to receive the tube and contactor. This hole could include female threads sized to receive male threads on the tube. The ogive could also include a threaded boss or other convenient attachment device.

The preceding description contains significant detail, but it should not be construed as limiting the scope of the invention but rather as providing illustrations of the preferred embodiments of the invention. As an example, the physical characteristics of the base could be modified substantially while still providing the basic function of attaching the standoff device to the ogive. Thus, the scope of the invention should be fixed by the following claims, rather than by the examples given.

The invention claimed is:

1. A grenade round particularly adapted for breaching a door having an outer side and an inner side while minimizing the production of flying debris on said inner side of said door, comprising:

a. a low pressure case containing a propulsion system;

b. a projectile mated to said low pressure case;

c. said projectile having a forward end and an aft end;

d. said projectile including an explosive charge;

e. said projectile including an ogive proximate said forward end, with said ogive having a forward extreme, f. said ogive containing a fuse assembly configured to detonate said explosive charge upon experiencing a significant deceleration;

g. wherein said projectile has a central axis;

h. a standoff device attached to said forward end of said ogive and extending forward therefrom along said central axis said standoff device including i. a base, attached to said ogive proximate said forward extreme, said base having a hole aligned with said central axis of said projectile, ii. a tube having a hollow interior inserted in said hole in said base, said hollow tube having a forward end and an aft end, with said aft end being in contact with said ogive, iii. a contactor, having a forward end and an aft tip, said contactor being placed within said hollow interior of said tube, said forward end of said contactor extending forward of said tube and said aft tip of said contactor being positioned proximate said forward extreme of said ogive, and iv. a mechanical interlock between said contactor and said tube, with said mechanical interlock being configured to resist sliding movement between said contactor and said tube until it is overcome by a striking force on said forward end of said contactor, after which said mechanical interlock allows said contactor to slide aft within said tube.

2. A grenade round as recited in claim 1, wherein said contactor includes a hollow passage extending from said forward end to said aft tip.

3. A grenade round as recited in claim 1, wherein:

said aft tip of said contactor is separated from said forward extreme of said ogive.

4. A grenade round as recited in claim 1, wherein:

said contactor has a flange proximate said forward portion of said contactor, said flange sized to fit over said forward portion of said hollow tube thereby forming said mechanical interlock.

5. A grenade round as recited in claim 4, wherein:

a. said hollow tube is made of ductile material; and b. said flange and said hollow tube are configured such that when said contactor strikes said outer side of said door said flange will plastically deform said hollow tube, thereby allowing said contactor to move toward said ogive.

6. A grenade round as recited in claim 1, wherein:

a. said hollow tube has a forward portion;

b. said contactor has at least one cannelure; and c. at least some of said forward portion of said hollow tube is plastically deformed into said at least one cannelure to form a cannelure crimp, thereby forming said mechanical interlock.

7. A grenade round as recited in claim 6, wherein said hollow tube is made of a ductile material so that when said contactor strikes said outer side of said door said cannelure crimp will release, thereby allowing said contactor to move toward said ogive.

8. A grenade round as recited in claim 6, wherein said contactor has a plurality of cannelures and at least some of said forward portion of said hollow tube is plastically deformed into one of said plurality of cannelures to form said mechanical interlock.

9. A grenade round as recited in claim 7, wherein said contactor has a plurality of cannelures and at least some of said forward portion of said hollow tube is plastically deformed into one of said plurality of cannelures to form said mechanical interlock.

10. A grenade round as recited in claim 1, wherein said base is attached to said ogive by adhesive.

11. A grenade round as recited in claim 3, wherein said base is attached to said ogive by adhesive.

12. A grenade round as recited in claim 4, wherein said base is attached to said ogive by adhesive.

13. A grenade round configured to detonate against a target surface, comprising:

a. a case containing a propulsion system;

b. a projectile mated to said case;

c. said projectile having a forward end and an aft end;

d. said projectile including an explosive charge;

e. said projectile including an ogive proximate said forward end, with said ogive having a forward extreme, f. said ogive containing a fuse assembly configured to detonate said explosive charge upon experiencing a significant deceleration;

g. wherein said projectile has a central axis;

h. a standoff device attached to said forward end of said ogive and extending forward therefrom along said central axis, said standoff device including i. a base, attached to said ogive proximate said forward extreme, said base having a hollow passage aligned with said central axis of said projectile, said base having a forward end and an aft end, with said aft end of said base covering a substantial portion of said ogive and being connected to said ogive by an adhesive, ii. a tube having a hollow interior inserted in said hollow passage in said base, said hollow tube having a forward end and an aft end, with said aft end being in contact with said ogive, iii. a contactor, having a forward end and an aft tip, said contactor being placed within said hollow interior of said tube, said forward end of said contactor extending forward of said tube and said aft tip of said contactor being positioned proximate said forward extreme of said ogive, and iv. a mechanical interlock between said contactor and said tube, with said mechanical interlock being configured to resist sliding movement between said contactor and said tube until it is overcome by a striking force on said forward end of said contactor, after which said mechanical interlock allows said contactor to slide aft within said tube.

14. A grenade round as recited in claim 13, wherein said contactor includes a hollow passage extending from said forward end to said aft tip.

15. A grenade round as recited in claim 13, wherein:

said contactor has a flange proximate said forward portion of said contactor, said flange sized to fit over said forward portion of said hollow tube thereby forming said mechanical interlock.

16. A grenade round as recited in claim 15, wherein:

a. said hollow tube is made of ductile material; and b. said flange and said hollow tube are configured such that when said contactor strikes said outer side of said door said flange will plastically deform said hollow tube, thereby allowing said contactor to move toward said ogive.

17. A grenade round as recited in claim 13, wherein:

a. said hollow tube has a forward portion;

b. said contactor has at least one cannelure; and c. at least some of said forward portion of said hollow tube is plastically deformed into said at least one cannelure to form a cannelure crimp, thereby forming said mechanical interlock.

18. A grenade round as recited in claim 17, wherein said hollow tube is made of a ductile material so that when said contactor strikes said outer side of said door said cannelure crimp will release, thereby allowing said contactor to move toward said ogive.

* * * * *